US008833114B2

(12) United States Patent
Szczygielski

(10) Patent No.: US 8,833,114 B2
(45) Date of Patent: Sep. 16, 2014

(54) THEFT-RESISTANT GUARD FOR A ROLL-UP DOOR LOCK

(75) Inventor: Mark J Szczygielski, Akron, NY (US)

(73) Assignee: Whiting Door Manufacturing Corp., Akron, NY (US)

( * ) Notice: Subject to any disclaimer, the term of this patent is extended or adjusted under 35 U.S.C. 154(b) by 0 days.

(21) Appl. No.: 13/506,021

(22) Filed: Mar. 21, 2012

(65) Prior Publication Data

US 2013/0247627 A1 Sep. 26, 2013

(51) Int. Cl.
*E05B 67/38* (2006.01)

(52) U.S. Cl.
USPC ..... 70/56; 70/54; 70/203; 70/212

(58) Field of Classification Search
USPC ..... 70/54–56, 95, 202, 203, 211, 212
See application file for complete search history.

(56) References Cited

U.S. PATENT DOCUMENTS

| | | | | |
|---|---|---|---|---|
| 4,895,007 | A * | 1/1990 | Eberly | 70/54 |
| 5,737,946 | A * | 4/1998 | Sole et al. | 70/54 |
| 5,743,118 | A * | 4/1998 | Anderson | 70/56 |
| 6,581,419 | B1 * | 6/2003 | Strodtman | 70/56 |
| 7,017,954 | B2 * | 3/2006 | Eklund et al. | 70/211 |
| 7,874,188 | B2 * | 1/2011 | Chudzicki | 70/56 |
| 7,878,032 | B1 * | 2/2011 | Gogel | 70/56 |

* cited by examiner

*Primary Examiner* — Christopher Boswell
(74) *Attorney, Agent, or Firm* — Phillips Lytle LLP

(57) ABSTRACT

The present invention broadly provides a theft-resistant guard (20) for a roll-up door lock mechanism (21). The improvement broadly comprises: the guard (20) being non-removably mounted on the lock mechanism (21) for movement with the handle (29). The guard has a proximal marginal end portion (34) arranged to partially embrace the pivotal connection between the latch cam (24) and plate (23), has an intermediate portion (35) adapted to partially embrace the handle, and has a distal marginal end portion (36) adapted to partially embrace the hold-closed keeper (32) when the handle is in the closed position, such that the guard may not be readily removed from the lock mechanism.

16 Claims, 3 Drawing Sheets

THEFT-RESISTANT GUARD FOR A ROLL-UP DOOR LOCK

TECHNICAL FIELD

The present invention relates generally to the field of roll-up doors, and, more particularly, to improved theft-resistant guards that are adapted to be mounted on lock mechanisms mounted on the lowermost door panels, and that are adapted to resist or inhibit forcible entry into the cargo body.

BACKGROUND ART

Roll-up doors are commonly used to provide access to the cargo-carrying bodies of trucks and trailers. They are also used on static structures, such as garage and warehouse doors and the like.

Roll-up door lock mechanisms have been in common use for many years.

Early forms of such lock mechanisms had a latch cam pivotally mounted on the lowermost door panel, and arranged to selectively engage a catch pin located in the door sill. A handle was mounted on the pivotal axis of the latch cam, and could be manually moved between opened and closed positions. Hold-open and hold-closed keepers were provided on the latch plate to selectively hold the handle in the opened and closed positions, respectively. When the handle was in its closed position, the hold-closed keeper was adapted to receive a padlock so to prevent the door from being unintentionally opened.

In early forms, the latch cam was secured to the handle mechanism so that these two members rotated together about the pivotal axis. See, e.g., U.S. Pat. No. 3,642,314.

Later developments improved on this by allowing some relative movement between the latch cam and the handle mechanism. In some forms, the latch cam could move by gravity relative to the closed handle. See, e.g., U.S. Pat. No. 3,642,314, supra. This had the advantage of allowing the latch cam to more firmly engage the catch pin when the vehicle was traveling so as progressively move the latch cam under the catch pin and to prevent a "dancing door".

Later improvements added a spring between the latch cam and the handle to bias the latch cam to move into ever-tighter engagement with the catch pin as the vehicle traveled down a highway. This improvement was described in *Overhead Door Corp. v. Whiting Roll-up Door Mfg. Corp.,* 1981 WL 48559, 215 USPQ 428 (W.D.N.Y. 1981).

While such roll-up doors and lock mechanisms are well known and in common use today, the problem of theft via forcible entry has persisted. Often, trucks or trailers are parked in vulnerable out-of-the-way positions. In other cases, trailers are carried by trains which may sit in rail yards for extended periods, or may travel through remote areas. The continuing problem of cargo theft is documented and recorded in Lockridge, "Cargo Safe & Secure", *Heavy Duty Trucking* (July, 2011).

To strengthen the lock mechanism against possible theft, others have proposed to provide various removable anti-theft shields on the door handle. See, e.g., U.S. Pats. No. 5,737,946 and 7,874,188, the disclosures of which are hereby incorporated by reference. However, these forms contemplated that the anti-theft devices could be slipped on or added to an existing door lock. The apparent intent here was that such shields could be retrofitted to existing locks.

The problem with this arrangement is that the driver might typically operate the lock mechanism in daily use. The latch shield, while having a laudable purpose, interferes with, and impedes, the free unencumbered operation of the lock mechanism. Hence, some drivers would unlock the mechanism and physically remove the anti-theft shield to it from being an obstruction to the free use of the lock. Common complaints of removable guards are that they become damaged, lost, stolen or simply forgotten.

It is appreciated that no device can prevent theft by damage to a lock mechanism. Rather, such anti-theft devices simply provide an additional obstruction to a would-be-thief. It is felt that delay in defeating a lock mechanism is an additional theft deterrent in and of itself.

Accordingly, it would generally desirable to provide an improved anti-theft or theft-resistant shield or guard that can be associated with a roll-up door lock mechanism and that is not readily removable, even by the driver of the vehicle.

DISCLOSURE OF THE INVENTION

With parenthetical reference to the corresponding parts, portions or surfaces of the disclosed embodiment, merely for the purposes of illustration, and not by way of limitation, the present invention broadly provides a theft-resistant guard (20) for a roll-up door lock mechanism (21). The lock mechanism has a plate (23) adapted to be attached to the door (22), has a latch cam (24) pivotally mounted on the plate and adapted to selectively engage a catch pin (26) mounted on the door sill (28), has a handle (29) pivotally mounted on the plate and arranged to selectively move the latch cam between a closed position and an opened position, and has a hold-closed keeper (32) mounted on the plate and arranged to selectively engage the handle for releasably holding the handle in the closed position. The improvement broadly comprises: the guard being non-removably mounted on the lock mechanism for movement with the handle; the guard having a proximal marginal end portion (34) arranged to partially embrace or surround the pivotal connection between the latch cam and plate, having an intermediate portion (35) adapted to partially embrace or surround an intermediate portion of the handle, and having a distal marginal end portion (36) adapted to partially embrace or surround the hold-closed keeper (32) when the handle is in the closed position; whereby the guard may not be readily removed from the lock mechanism.

The guard may be a plate-like member having a central portion mounted on the lock mechanism farther away from the plate than the handle and latch cam, and wherein the central portion is arranged substantially parallel to the plate.

The plate-like member may have a first tab portion (41) folded inwardly toward the plate.

The plate-like member may have a second tab portion (43) folded inwardly toward the plate.

The fold lines (42, 44) between the central portion and the first and second tab portions (41, 43) may be substantially perpendicular to one another such that edges of the first and second tab portions are positioned adjacent one another.

The adjacent edges of the first and second tab portions may be welded together (51).

The plate-like member may have a third tab portion (45) folded inwardly toward the plate.

The plate-like member may have a fourth tab portion (48) folded inwardly toward the plate.

The improvement may further include a brace member (52) secured to the second and third tab portions.

The brace member may be welded to the second and third tab portions.

The improvement may further include a driver (54) embracing an intermediate portion of the handle and secured to the central portion and the second tab portion.

The driver (54) may be an L-shaped member having one marginal end portion secured to the central portion, and having another marginal end portion secured to the second tab portion.

The handle (29) may be adapted to engage the second tab portion (43) when the handle is rotated in one direction relative to the plate, and may be adapted to engage the driver (54) when the handle is rotated in the opposite direction relative to the plate.

The improvement may further include a hold-open keeper (31) mounted on the plate and arranged to selectively engage the handle (29) when the handle is in the opened position.

The second tab portion may have a recess to allow the hold-open keeper to selectively engage the handle when the handle is in the opened position.

The latch cam and handle may be mounted for relative angular movement.

The improvement may further include a resilient member (30) operatively arranged to urge the latch cam to move in one angular direction relative to the handle when the handle is in the closed position.

Accordingly, the general object of the invention is to provide an integral theft-resistant guard or shield for a roll-up door lock mechanism.

Other object is to provide a theft-resistant guard or shield for a roll-up door lock mechanism that cannot be readily removed by the driver or other authorized user of the vehicle.

These and other objects will become apparent from the foregoing and ongoing written specification, the drawings and appended claims

DESCRIPTION OF THE PREFERRED EMBODIMENTS

Figure 2:
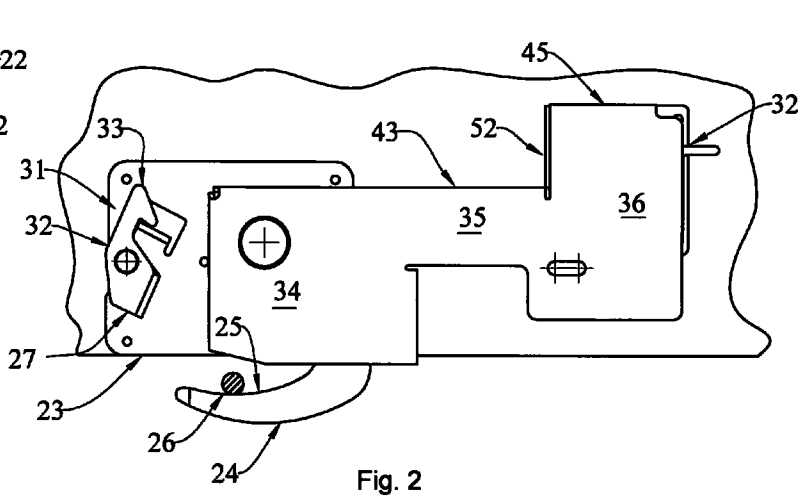
FIG. 2 is a front elevation of the theft-resistant guard and lock mechanism shown in FIG. 1.
Figure 1:
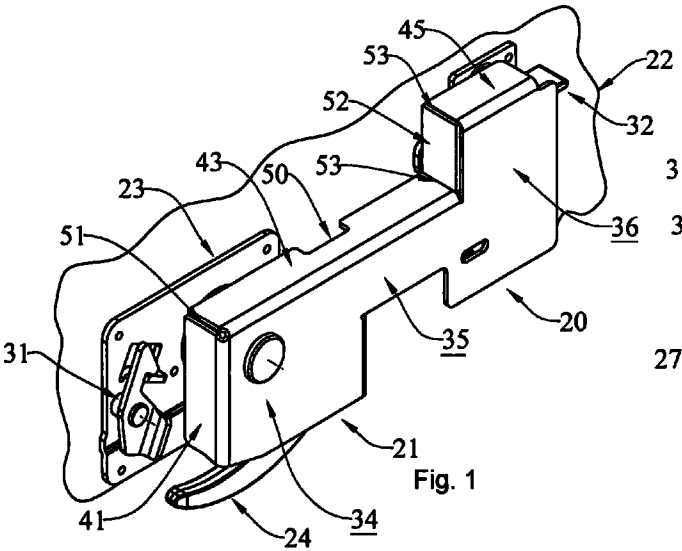
FIG. 1 is a fragmentary isometric view of the improved theft-resistant guard mounted on a roll-up door lock mechanism which, in turn, is shown as being mounted on a portion of the lower panel of a roll-up door.
Figure 4:
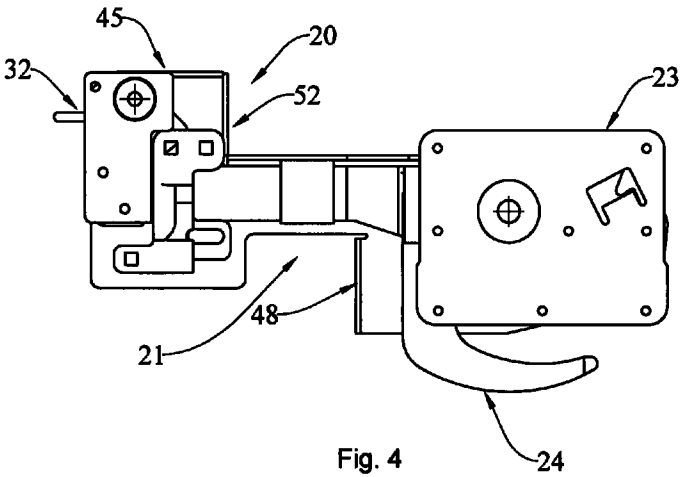
FIG. 4 is a rear elevation of the structure shown in FIG. 3.
Figure 3:
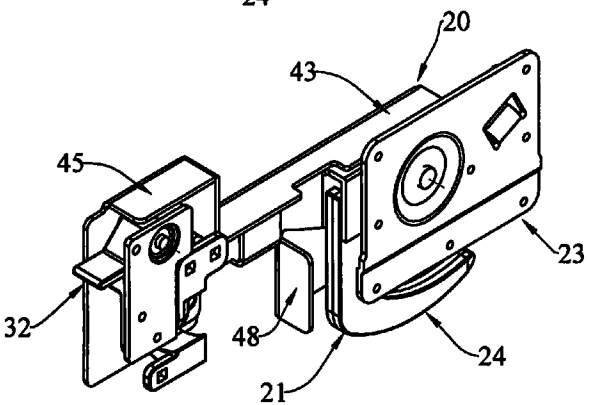
FIG. 3 is a rear isometric view of the guard and lock mechanism, with the handle removed for clarity of illustration.
Figure 8:
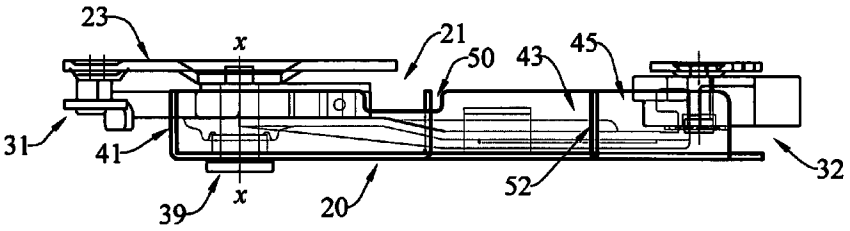
FIG. 8 is a top plan view of a structure shown in FIG. 5.
Figure 5:
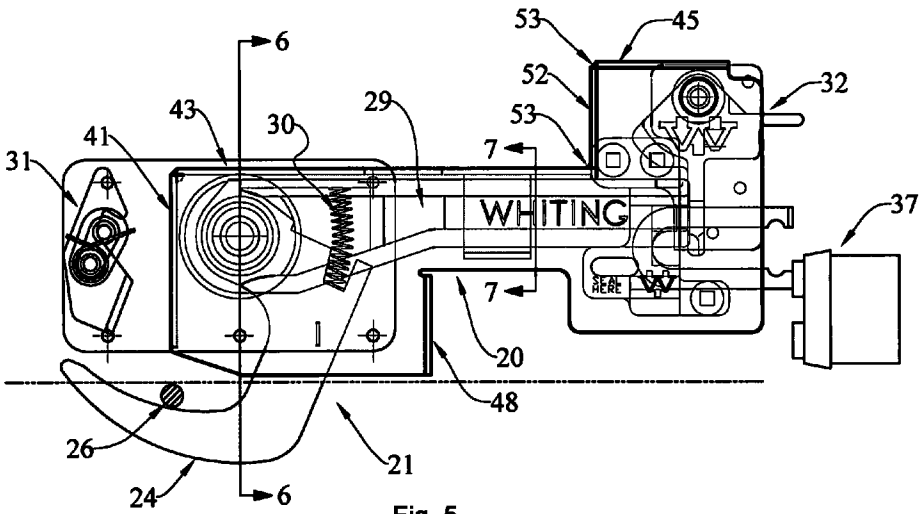
FIG. 5 is a fragmentary front elevation of the improved guard and lock mechanism, and illustrating portions of the latch cam, the handle, and the hold-closed keeper, and a pad lock associated therewith.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings and more particularly to FIGS. 1-4, thereof, the present invention broadly provides improved theft-resistant guards, of which a presently-preferred embodiment is generally indicated at 20, and that is adapted to be non-removably mounted on a roll-up door lock mechanism, generally indicated at 21.

The lock mechanism is adapted to be mounted on the lower marginal end portion of the lowermost panel 22 of a roll-up door The lock mechanism has, in pertinent part, a plate 23 adapted to be attached (e.g., riveted) to the door panel, and a latch cam 24 pivotally mounted on the plate for rotation about horizontal axis x-x. The latch cam 24 has a cam surface 25 that is adapted to engage a catch pin 26 mounted on the sill 28 of the cargo body. The locking mechanism also has a handle 29 pivotally mounted on the plate for rotation about axis x-x, and arranged to selectively move the latch cam between a closed position (as shown in FIGS. 1-5) and an opened position (not shown) in the conventional manner.

Figure 6:
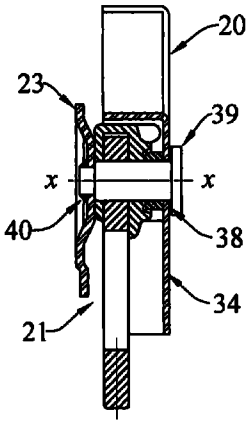
FIG. 6 is a fragmentary vertical sectional view thereof, taken generally on line 6-6 of FIG. 5, and showing the guard as being secured to the lock mechanism pivot pin outboard of the handle and latch cam.

As best shown in FIG. 6, a spring 30 is compressed between the handle and the latch cam to urge the latch cam to move in a clockwise direction into ever-tighter engagement with catch pin 26 when the handle is in its closed position so as to prevent a "dancing door" when the vehicle travels.

The lock mechanism is also shown as having a hold-open keeper assembly, generally indicated at 31, and a hold-closed keeper assembly, generally indicated at 32. When the handle is in its closed position and engaged with hold-closed keeper assembly 32, the shackle of a pad lock 37 may pass through a pair of aligned openings in the handle and the keeper. Thereafter, the lock may be selectively closed or locked to prevent unintended opening of the lock mechanism.

The hold-open keeper mechanism 31 is shown as including an intermediately-pivoted lever 32 having an upper portion 33 and a lower portion 27. This intermediately-pivoted lever may be spring-biased to move to the position shown in FIG. 2.

The lock mechanism, as heretofore described, is in common use, and is sold by Whiting Roll-up Door Mfg. Corp., 113 Cedar Street, Akron, N.Y. 14001, as its Model 77 lock mechanism.

The improved guard 20 differs from prior art guards in that the improved guard is adapted to be permanently (i.e., non-removably) mounted on the lock mechanism. As shown in FIG. 6, the guard has one marginal end portion 34 arranged to partially embrace the pivotal connection between the latch cam and plate, has an intermediate portion 35 adapted to partially embrace an intermediate portion of the handle, and has a distal marginal end portion 36 adapted to partially embrace portions of the hold-closed keeper when the handle is in its closed position.

As best shown in FIG. 6, the proximal marginal end portion 34 has a hole 38 that is adapted to fit around and be penetrated by headed pivot pin 39. The other end of this pivot pin is secured, as by weldments 40, to plate 23. The guard 20 is adapted to move generally with the handle about the axis x-x of pivot pin 39. However, the guard may experience some limited pivotal movement about axis x-x relative to the handle.

Figure 9:
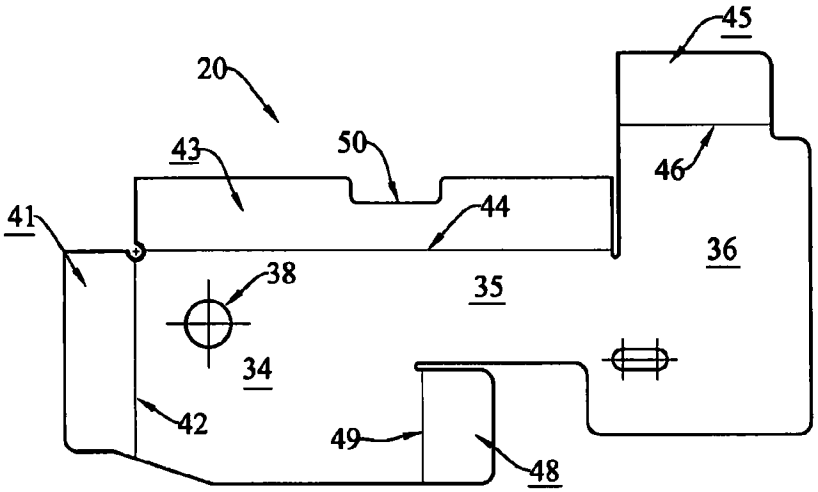
FIG. 9 is a plan view of the blank used to form the improved guard, prior to bending of the various tab portions.
Figure 11:
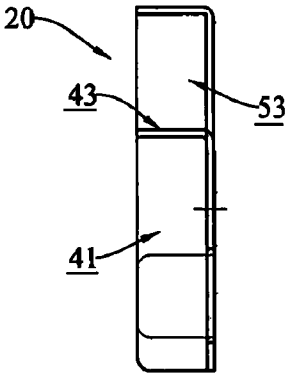
FIG. 11 is a left end elevation of the improved guard shown in FIG. 10.
Figure 10:
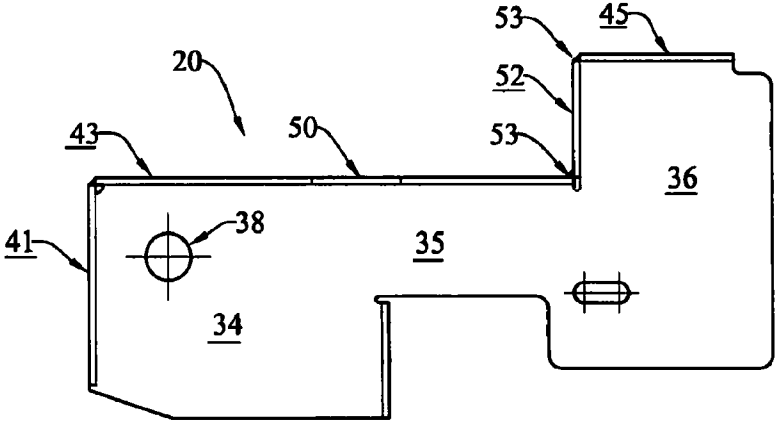
FIG. 10 is a front view of the improved guard, as folded and formed.
Figure 12:
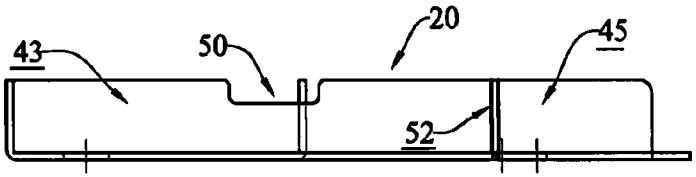
FIG. 12 is a top plan view of the improved guard shown in FIG. 10.

Referring now to FIGS. 7-12, the improved guard may be formed from a stamped planar blank of sheet material, and is preferably formed of steel or the like. As best shown in FIG. 9, the blank has the proximal marginal end-portion 34, the intermediate portion 35, and the distal marginal end portion 36. A first tab portion 41 extends leftwardly from vertical fold line 42. A second tab portion 43 shows as extending upwardly from a second horizontal fold line 44. A third tab portion 45 is shown as extending upwardly from horizontal third fold line 46. A fourth tab portion 48 is shown as extending rightwardly from vertical fold line 49. Second tab portion 43 is shown as having a recess 50 to accommodate passage of the upper marginal end portion of hold-open keeper 31 when the handle is rotated from its closed position to its opened position.

The blank shown in FIG. 9 maybe stamped from suitable plate-like stock, and the various portions may be folded about their previously indicated fold lines so as to partially embrace and surround proximate portions of the lock mechanism. The adjacent marginal end portions of the first and second tab portions 41, 43 may be secured together by a weldment 51. A brace, generally indicated at 52, may extend between the proximate portions of the second and third portions, and may be secured by various weldments, severally indicated at 53.

Thus, the proximal marginal end portion of the guard, together with folded or in-turned first and second tab portions are adapted to partially embrace or surround the pivotal connection between the latch mechanism and the handle mechanism with the plate. The brace 52 and folded third tab portion 53 are adapted to partially embrace or surround portions of the hold-closed keeper and the shackle of the pad lock. In-turned fourth tab portion 48 is adapted to impede access to the latch cam.

Therefore, the present invention provides an improved theft-resistant guard for a roll-up door lock mechanism. The lock has a plate adapted to be attached to the door, has a latch cam pivotally mounted on the plate and adapted to selectively engage a catch pin mounted on the door sill, has a handle pivotally mounted on the plate and arranged to selectively move the latch cam between a closed position and an opened position, and has a hold-closed keeper mounted on the plate and arranged to selectively engage the handle for releasably holding the handle in a closed position. The improvement broadly includes the guard being non-removably mounted on the lock mechanism for movement with the handle. The guard has a proximal marginal end portion adapted to partially embrace or surround the pivotal connection between the latch cam and plate, has an intermediate portion adapted to partially embrace or surround and intermediate portion of the handle, and has a distal marginal end portion adapted to partially embrace or surround the keeper when the handle is in its closed position.

Figure 7:
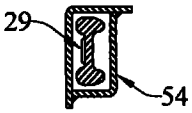
FIG. 7 is a fragmentary transverse vertical sectional view thereof, taken generally on line 7-7 of FIG. 5, and showing the driver

As shown in FIG. 7, an L-shaped driver, generally indicated at 54, has its marginal ends secured to portions of the hand of the guard intermediate portion and the second tab portion so as to embrace an intermediate portion of the handle. This driver provides surfaces that engage the handle when the handle is rotated in a clockwise and counter-clockwise direction relative to the door panel. In other words, the driver permits some limited pivotal movement of the guard relative to the handle, while constraining the guard to generally move with the handle when the handle is opened and closed.

Modifications

The present invention contemplates that many changes and modifications may be made. For example, while the improve guard is shown as embracing a Whiting Model 77 lock mechanism, such guard could be used with other types of lock mechanisms as well. Similarly, while the shape and configuration of the blank shown in FIG. 9 is specially tailored and configured for use with a Whiting Model 77 lock mechanism, the general shape and configuration of the blank can be readily changed or modified for use with other lock mechanisms.

While it is presently preferred that the guard be formed of a suitable steel, other materials may be substituted therefor.

Therefore, while one-preferred form of the improved theft-resistant guard has been shown and described, and several modifications and changes thereof, discussed, persons skilled in this art will readily appreciate the various additional changes and modifications may be made without departing from the spirit of the invention, as defined and differentiated by the following claims.

What is claimed is:

1. A theft-resistant guard for a lock for a roll-up door, said lock having a plate adapted to be attached to said door, having a latch cam pivotally mounted on said plate and adapted to selectively engage a pin mounted on a sill, having a handle pivotally mounted on said plate and arranged to selectively move said latch cam between a closed position and an open position, and having a keeper mounted on said plate and arranged to selectively engage said handle for releasably holding said handle in said closed position, wherein the improvement comprises:

said guard being non-removably mounted on said lock for movement with said handle;

said guard having a proximal marginal end portion arranged to embrace the pivotal connection between said latch cam and plate, having an intermediate portion adapted to embrace said handle, and having a distal marginal end portion adapted to embrace said keeper when said handle is in said closed position;

wherein said guard proximal marginal end portion has an opening; and wherein a pivot pin has a head portion at one end arranged to bear against the outer surface of said guard and has its other end welded to said plate such that said guard may not be removed from said lock.

2. The improvement as set forth in claim 1 wherein said guard is a plate-like member having a central portion mounted on said lock farther away from said plate than said handle and latch cam, said central portion being arranged substantially parallel to said plate.

3. The improvement as set forth in claim 2 wherein plate-like member has a first portion folded inwardly toward said plate.

4. The improvement as set forth in claim 3 wherein said plate-like member has a second portion folded inwardly toward said plate.

5. The improvement as set forth in claim 4 where the fold lines between said central portion and said first and second portions are substantially perpendicular to one another such that adjacent marginal portions of said first and second portions are positioned adjacent one another.

6. The improvement as set forth in claim 5, and wherein the adjacent marginal end portions of said first and second portions are welded together.

7. The improvement as set forth in claim 5 wherein said plate-like member has a third portion folded inwardly toward said plate.

8. The improvement as set forth in claim 7 wherein said plate-like member has a fourth portion folded inwardly toward said plate.

9. The improvement as set forth in claim 7, and further comprising:

a brace member secured to said second and third portions.

10. The improvement as set forth in claim 9 wherein said brace member is welded to said second and third portions.

11. The improvement as set forth in claim 4, and further comprising:

a driver embracing an intermediate portion of said handle and secured to said central and second portions.

12. The improvement as set forth in claim 11 wherein said driver is an L-shaped member having one marginal end portion secured to said central portion and having another marginal end portion secured to said second portion.

13. The improvement as set forth in claim 12 wherein said handle is adapted to engage said second portion when said handle is rotated in one direction relative to said plate, and is adapted to engage said driver when said handle is rotated in the opposite direction relative to said plate.

14. The improvement as set forth in claim 4, and further comprising:

a hold-open keeper mounted on said plate and arranged to selectively engage said handle when said handle is in said open position; and wherein said second portion has a recess to allow said hold-open keeper to selectively engage said handle when said handle is in said open position.

15. The improvement as set forth in claim 1 wherein said latch cam and handle are mounted for relative angular movement.

16. The improvement as set forth in claim 15, and further comprising:

a resilient member operatively arranged to urge said latch cam to move in one angular direction relative to said handle when said handle is in said closed position.

* * * * *